US006108864A

United States Patent [19]

Thomas et al.

[11] Patent Number: 6,108,864

[45] Date of Patent: Aug. 29, 2000

[54] VACUUM CLEANER HAVING A REUSABLE DIRT CUP

[75] Inventors: Joyce K. Thomas; Samuel E. Hohulin, both of Lexington; Jeffrey Smith, Bloomington, all of Ill.

[73] Assignee: White Consolidated Industries, Inc., Cleveland, Ohio

[21] Appl. No.: 09/226,736

[22] Filed: Jan. 7, 1999

Related U.S. Application Data

[60] Provisional application No. 60/070,978, Jan. 9, 1998.

[51] Int. Cl.[7] ..... A47L 9/10

[52] U.S. Cl. ..... 15/350; 15/344; 15/329

[58] Field of Search ..... 15/329, 344, 350, 15/351

[56] References Cited

U.S. PATENT DOCUMENTS

| | | | |
|---|---|---|---|
| 2,974,346 | 3/1961 | Hahn | 15/344 |
| 4,209,875 | 7/1980 | Pugh et al. | 15/344 |
| 4,536,914 | 8/1985 | Levine | 15/344 |
| 4,573,237 | 3/1986 | Kochte et al. | 15/344 |
| 4,577,365 | 3/1986 | Yuen | 15/350 |
| 4,644,605 | 2/1987 | Joss et al. | 15/350 |
| 4,665,582 | 5/1987 | Richmond et al. | 15/344 |
| 4,876,763 | 10/1989 | Cho et al. | 15/329 |
| 4,905,342 | 3/1990 | Ataka | 15/344 |
| 4,967,443 | 11/1990 | Krasznai et al. | 15/350 |
| 5,056,186 | 10/1991 | Jiam-Fa | 15/344 |
| 5,659,922 | 8/1997 | Louis | 15/350 |

*Primary Examiner*—Theresa T. Snider
*Attorney, Agent, or Firm*—Pearne, Gordon, McCoy & Granger LLP

[57] ABSTRACT

A vacuum cleaner assembly including a motor housing, a motor and fan assembly mounted in the motor housing, and a dirt containment chamber having an air intake at one end. An apertured wall is provided at one end of the motor housing so that the fan is closely adjacent the aperture. A planar filter is provided within the containment chamber and extends from a distal end to a proximal end of the chamber to separate the chamber into an air flow chamber and a dirt chamber. The aperture is separated from air flow communication with said intake opening by the filter.

6 Claims, 4 Drawing Sheets

VACUUM CLEANER HAVING A REUSABLE DIRT CUP

CROSS REFERENCE TO RELATED APPLICATION

This application claims priority from U.S. provisional patent application No. 60/070,978 filed Jan. 9, 1998.

BACKGROUND OF THE INVENTION

This invention relates to vacuum cleaners and, more particularly, to vacuum cleaners having a dirt cup filter which need not be removed for periodic cleaning.

Typical arrangements for "clean-air" vacuum systems with a reusable dirt cup involve placing a filter between the fan eye and a dirt collection cup. In some applications, the filter is removably attached to the wall surrounding the fan eye. In this arrangement, when the dirt cup is removed there is no obstruction to directly emptying the dirt from the dirt cup container. However, dust which clings to the filter is exposed and can drop off the filter unimpeded unless the dirt cup is removed over a waste receptacle.

In other reusable dirt cup arrangements, such as the arrangement described in U.S. Pat. No. 4,665,582 the filter is removably mounted inside the dirt cup so that removal of the dirt cup and the filter mounted therein effectively traps dirt in the cup until the filter is removed. However, it should be appreciated that the cloth filter must be removed from the dirt cup in order to empty the contents thereof.

SUMMARY OF THE INVENTION

This invention provides a "clean-air" reusable dirt cup vacuum cleaner having a filter arrangement which is mounted in the dirt cup and which can be removed with the dirt cup without spilling the collected dirt until the dirt cup is emptied over a trash receptacle. The filter need not be removed from the dirt cup for each disposal but is easily removable for periodic thorough cleaning.

More specifically, this invention provides a vacuum cleaner having a motor housing with a motor and fan assembly mounted therein so that the fan is closely adjacent an end wall of the housing. A ring fitting surrounds the aperture and defines an opening for streamlined airflow to the fan eye. A dirt cup is removably attached to the end wall and defines a hollow containment chamber with a suction inlet opening at its distal end. The ring fitting has a hood portion extending across the aperture and has a rim portion extending around the periphery of the aperture, with the hood portion being integrally associated with a portion of the rim portion. A filter having at least one planer surface mounted within the containment chamber and separates the containment chamber into an airflow chamber and a dirt chamber with the suction inlet opening in fluid communication with the dirt chamber. The filter has a proximal edge in sealing communication with the end wall and the hood portion so that dirt laden air will be drawn through the suction opening, into the dirt chamber, and clean air will pass through the filter to the airflow chamber, through the aperture, and to the fan.

According to one aspect of this invention, the filter arrangement may be employed in a stick vacuum cleaner which may be converted to a hand held vacuum cleaner by removing the stick handle. The convertable stick vacuum cleaner has a floor engaging cleaning head pivoted thereto.

According to another aspect of this invention, the filter arrangement may be employed in a more conventional hand held vacuum cleaner having a containment chamber provided with a floor or upholstery engaging vacuum opening.

BRIEF DESCRIPTION OF THE DRAWINGS

It should be appreciated that, although the invention is illustrated in conjunction with stick and hand held vacuum cleaners, the invention is applicable to conventional upright and canister vacuum cleaners.

DETAILED DESCRIPTION OF THE INVENTION

Figure 1:
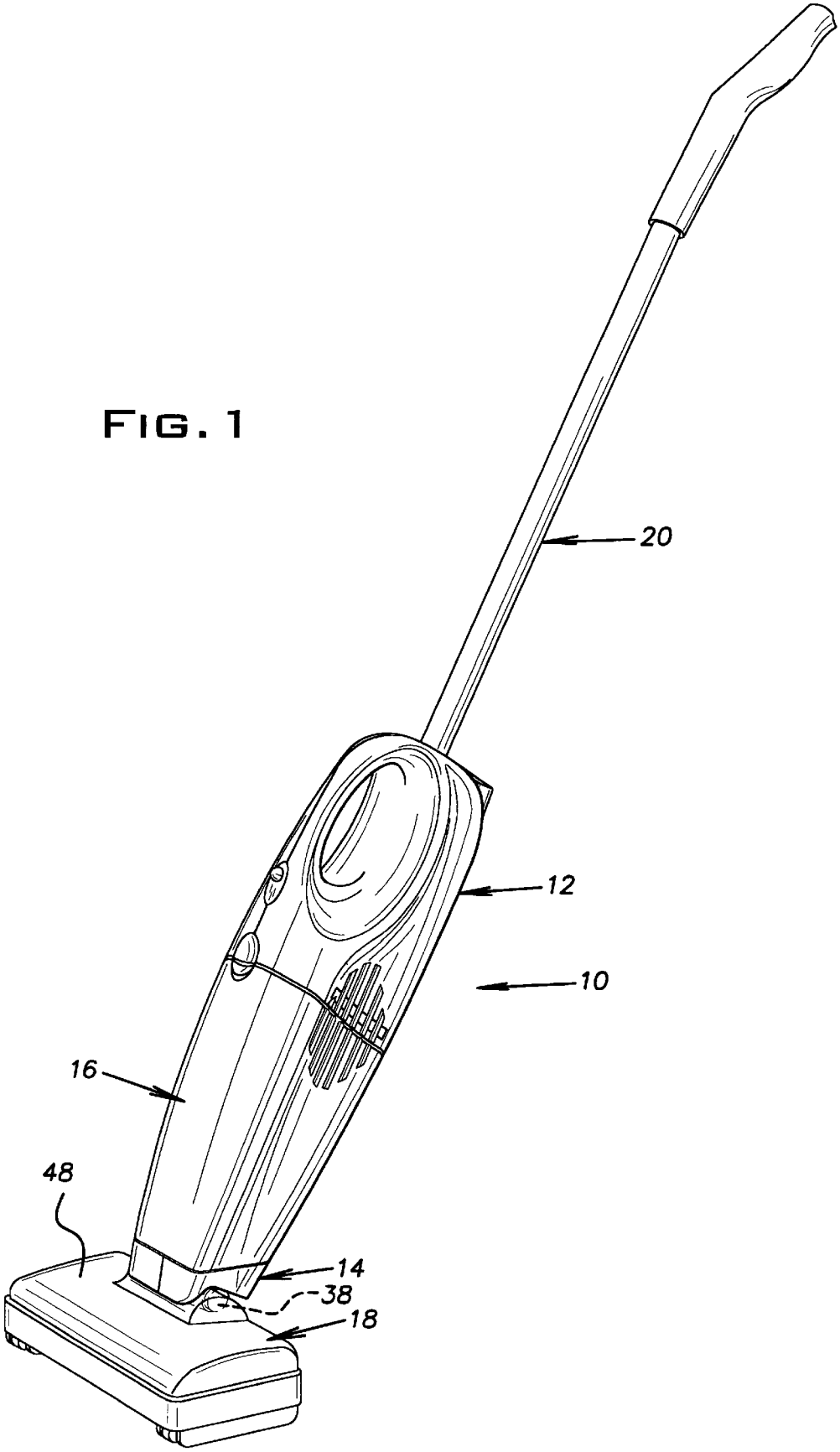
FIG. 1 is a perspective view of the vacuum cleaner assembly according to this invention.
Figure 2:
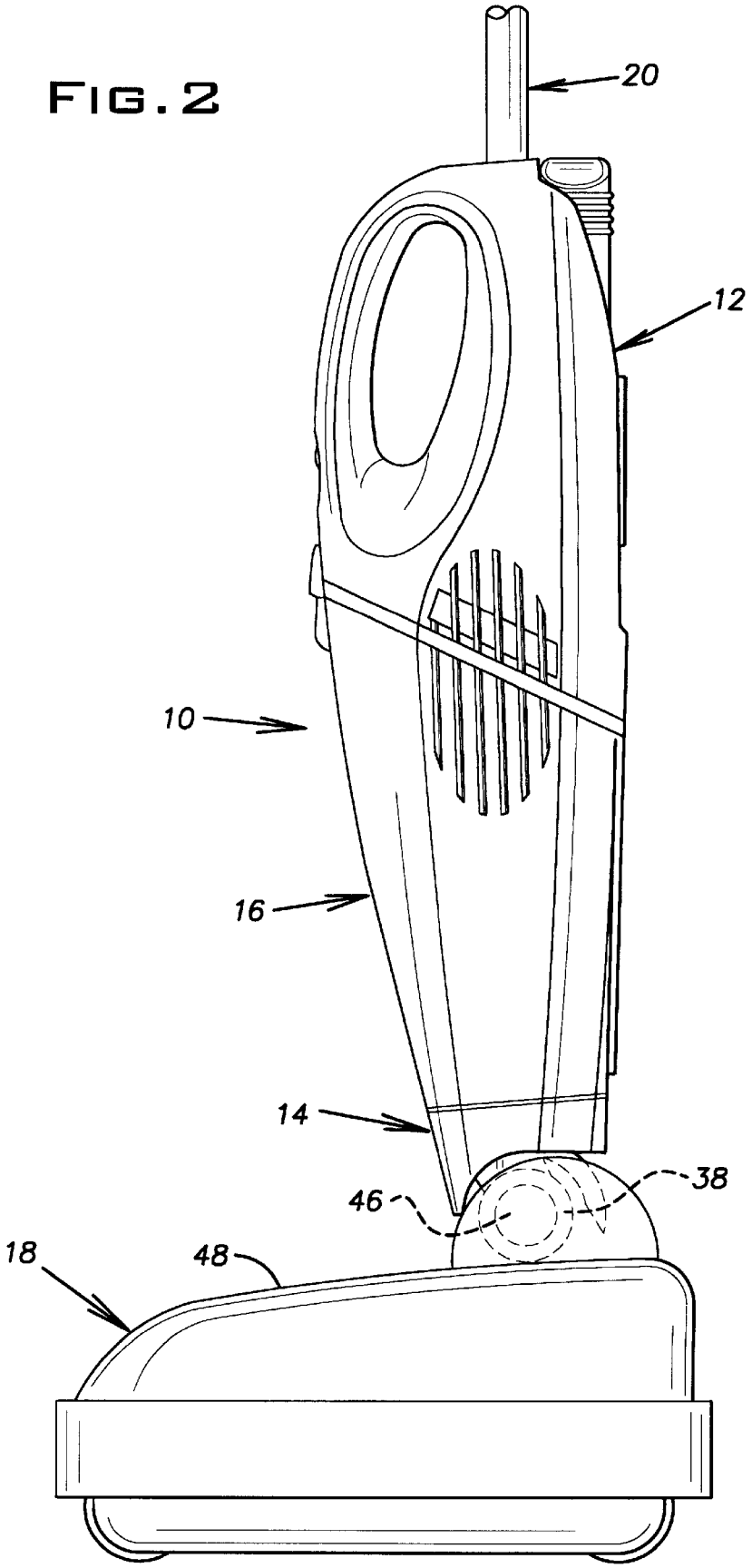
FIG. 2 is a side elevational view of the vacuum cleaner assembly.
Figure 3:
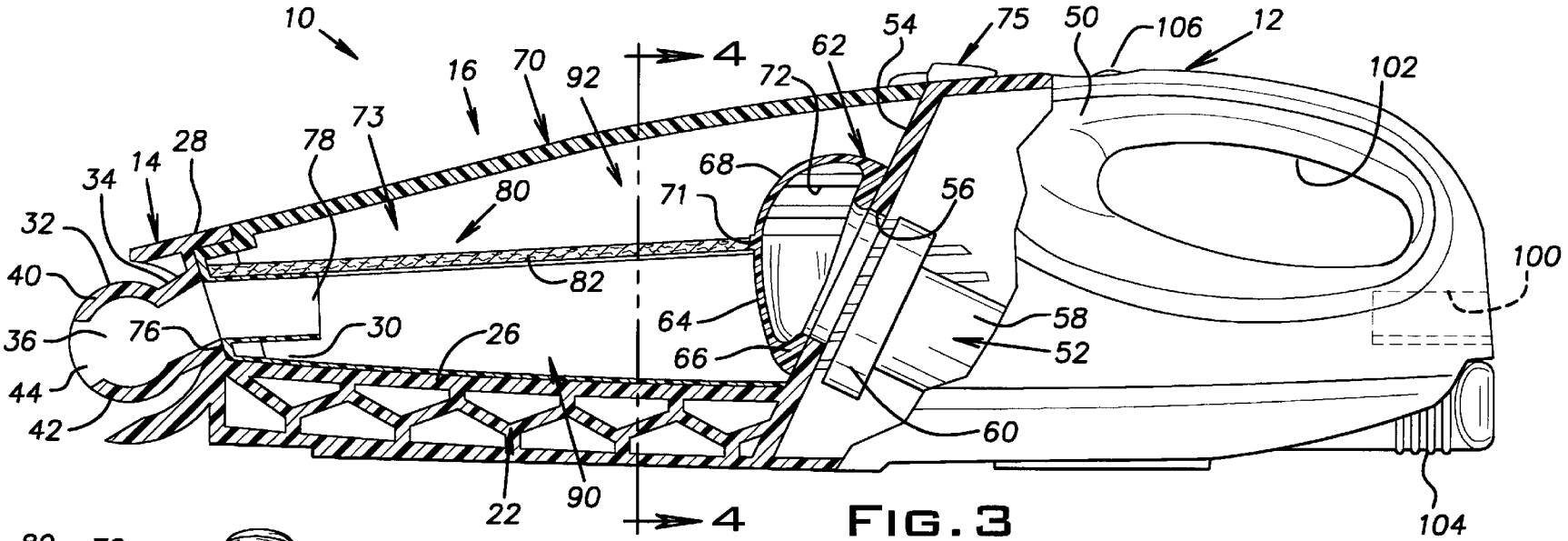
FIG. 3 is a fragmentary cross sectional view of the vacuum cleaner assembly.
Figure 6:
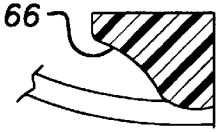
FIG. 6 is a fragmentary cross-sectional view, the plane of the section being indicated by the line 6—6 in FIG. 5.
Figure 5:
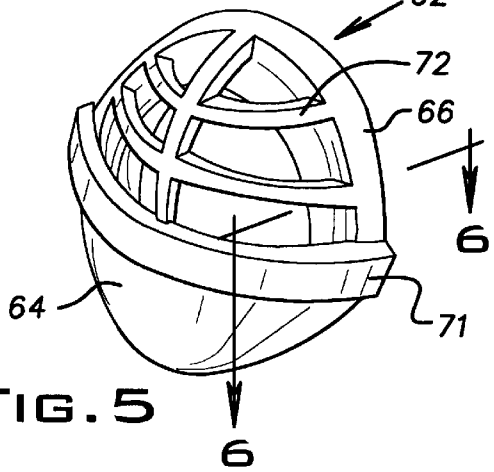
FIG. 5 is perspective view of a ring fitting according to this invention.

Referring now to FIGS. 1, 2 and 3 there is illustrated a vacuum cleaner assembly 10, comprising a power assembly 12, a mounting assembly 14, a filter assembly 16, a nozzle assembly 18 pivoted to the mounting assembly 14, and a removable handle 20. According to this aspect of the invention, the assembly 10 is in the form of a battery powered stick vac which may be converted to a hand vac by removing the handle 20. As will be discussed later, however, the invention may be embodied in a hand vac which does not include a pivotally connected rug engaging nozzle.

As may be seen most clearly in FIG. 3 the filter assembly 16 is adapted to be removably mounted on a frame 22 which has the power assembly 12 at one end and the mounting assembly 14 at its other end.

The frame 22 may be comprised of a generally bar-shaped support 26. The mounting assembly 14 is comprised of a hollow base 28 integral with one end of the bar-shaped support 26 and having a rearward side 30 inclined to the longitudinal direction of the bar-shaped support 26.

A hollow pivot cylinder 32 extends from the front of the mounting assembly 14 by a forwardly extending mounting stub 34. The pivot cylinder has end walls 36 and 38 (FIG. 1) joined by an upper partially circumferential wall 40 and a lower partially circumferential wall 42 to provide a forward circumferential gap 44. The gap 44 defines a passageway for air from the forward end of the mounting assembly 14 through the rear end thereof. An axially extending annular projection 46 (FIG. 2) is provided depending from the outside of each end wall 36 and 38 to serve as a labyrinth seal with and a pivot stub for a nozzle assembly 48. The pivot cylinder 32 is adapted to pivotally mount the nozzle assembly 48 and direct air from the nozzle assembly 48 to the filter assembly 16 in a manner more particularly pointed out in U.S. Pat. No. 4,665,582, the subject matter of which is incorporated herein by reference.

The power assembly 12 includes a housing 50 affixed to the rear of the bar-shaped support 26 for enclosing a motor and fan assembly 52 and electrical control circuits (not shown). The housing 50 has a front wall 54 provided with an aperture 56 therein. The motor and fan assembly 52 comprises a motor 58 and a fan 60 which are positioned by a mounting assembly (not shown) so that the fan 60 is closely adjacent to the wall 54 and is substantially coaxially mounted with respect to the aperture 56. A ring fitting 62 surrounds the aperture 56 and defines an opening for air flow to the fan 60.

The ring fitting 62 has a hood portion 64 extending across the aperture 56 and has a rim portion 66 extending around the periphery of the aperture 56 so that the hood portion 64 is integrally associated with a portion of the rim portion 66. An upper area 68 is separated from the hood portion 64 by a sealing band 71 and comprises an open area which is defined by grid members 72 and which permits air to enter the aperture 56. The rim portion 66 serves as a cowling to funnel air smoothly to the fan 60 with a minimum of turbulence so that the suction provided by the fan is enhanced.

Figure 4:
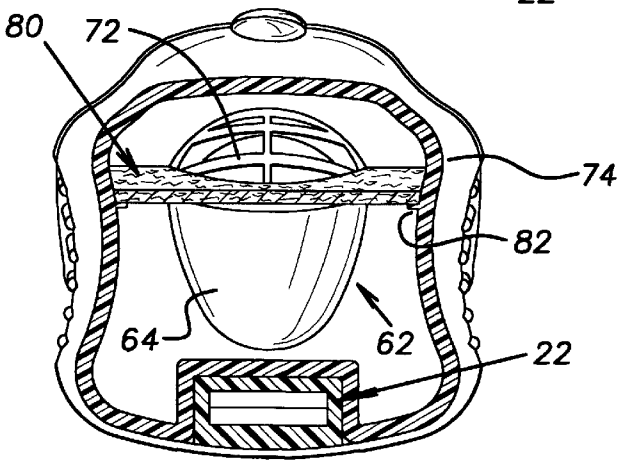
FIG. 4 is a cross-sectional view, the plane of the section being indicated by the line view of a ring 4—4 in FIG. 3.

The filter assembly 16 is removably mounted between the mounting assembly 14 and the power assembly 12. The filter assembly 16 comprises a dirt cup 70 defining a hollow containment chamber 73. As may be seen most clearly in FIG. 4 a wall 74 of the containment chamber 73 is formed to laterally surround the bar-shaped support 26 and to assist in mounting the filter assembly 16 between the mounting assembly 14 and the power assembly 12. More particularly, the filter assembly 16 is mounted by inserting one end in the mounting assembly 14 and pivoting the other end into place against the power assembly 12. During this pivoting operation the bar-shaped support 26 guides the filter assembly 16 until it is securely mounted in place by a releasable locking latch 75 mounted on the power assembly 12. The forward end of the dirt cup 70 has a planer surface which engages a recessed seal 76 surrounding the inlet opening. An inlet extension tube 78 projects into the containment chamber 73 to minimize gravitational dirt discharge.

The containment chamber 73 is separated by a substantially planar dust filter 80 which extends longitudinally in the chamber 73 and is supported therein on ribs 82 molded into the side wall of the dirt cup 70. The proximal end of the filter 80 is contoured to conform to and seal against the wall 54 and the band 71 of the ring fitting 62 (see FIG. 4).

The filter 80 divides the chamber 73 in to a dirt chamber 90 and an airflow chamber 92. Dirt and air flowing in to the dirt chamber 90 through the inlet opening are separated so that the air flows through the filter 80 into the airflow chamber 92 and to the fan 60. Since the airflow into the chamber 90 is essentially parallel to the surface of the filter 80 excessive build up of dirt on the filter is minimized. The airflow tends to scrub the dirt from the filter 80 during use. The dirt cup may be emptied by releasing the latch 75 and pivoting the dirt cup 70 outwardly. Dirt is retained in the dirt chamber 90 during this operation but is easily emptied therefrom over a dirt receptacle. From time to time the filter 80 may be removed for thorough cleaning or replacement, if necessary.

The vacuum cleaner assembly may be operated by the illustrated handle 20 or the handle 20 may be removed from its socket 100 and the assembly may be operated by grasping a handle 102. The assembly 10 may be powered by a removable battery pack 104 and controlled by an on/off switch 106. Alternately the vacuum assembly 10 may have a power cord (not shown).

As was previously indicated, and in accordance with a further aspect of this invention, the filter arrangement according to this invention may be employed in a hand held vacuum cleaner having a containment chamber provided with a floor carpet, or upholstery engaging vacuum opening.

Figure 7:
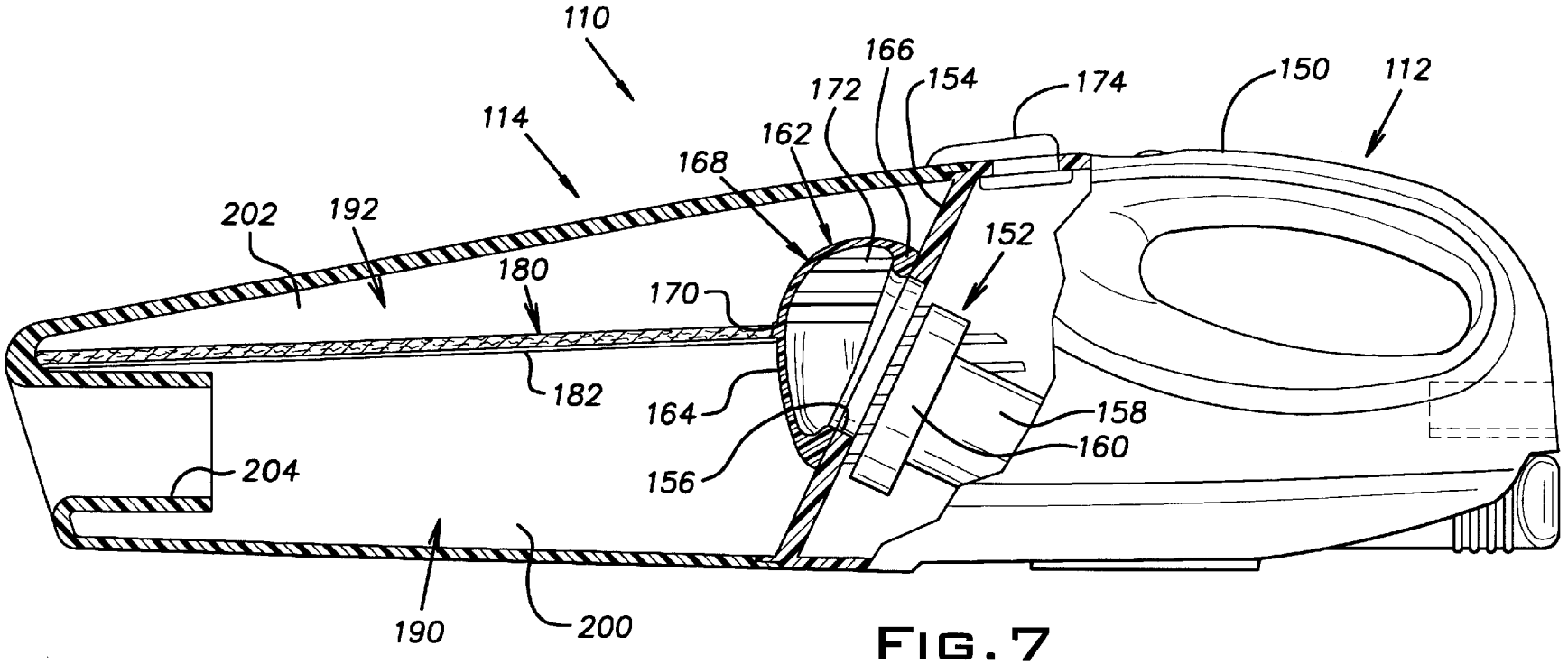
FIG. 7 is a fragmentary cross-sectional view of a vacuum cleaner assembly according to a further aspect of the invention.

Referring now to FIG. 7, there is illustrated a hand held vacuum cleaner 110 comprising a power assembly 112 and a filter assembly 114. The filter assembly 114 is detachably connected to the power assembly by a spring loaded latch 174.

The power assembly 112 includes a housing 150 which encloses a motor fan assembly 152 and electrical control circuits (not shown). The housing 150 has a front wall 154 provided with an aperture 156 therein. The motor and fan assembly comprises a motor 158 and a fan 160 which are positioned by a mounting assembly (not shown) so the fan 160 is closely adjacent the wall 154 and is substantially coaxially mounted with respect to the aperture 156. A ring fitting 162 surrounds the aperture 156 and defines an opening for air flow to the fan 160.

The ring fitting 162 has a hood portion 164 extending across the aperture 156 and has a rim portion 166 extending around the periphery of the aperture 156 so that the hood portion 164 is integrally associated with a portion of the rim portion. An upper area 168 is separated from the hood portion 164 by a sealing band 170 and comprises an open area which is defined by grid members 172 and which permits air to enter the aperture 156. The rim portion 166 serves as a cowling to funnel air smoothly to the fan 160 with a minimum of turbulence so that the suction provided by the fan is enhanced.

The filter assembly 114 is removably mounted on the power assembly 112 and comprises a dirt cup 190 defining a hollow containment chamber 192. The containment chamber 192 is separated by a substantially planer dust filter 180 which extends longitudinally in the chamber 192 and is supported therein on ribs 182 molded into the side wall of the dirt cup 190. The proximal end of the filter 180 is contoured to conform to and seal against the wall 154 and the band 170 of the ring fitting 162.

The filter 180 divides the chamber 192 into a dirt chamber 200 and an airflow chamber 202. Dirt and air flowing into the dirt chamber 200 through an inlet opening 204 are separated so that the air flows through the filter 180 into the airflow chamber 202 and to the fan 160. Since the airflow into the chamber 200 is essentially parallel to the surface of the filter 180, excessive build-up of dirt on the filter is minimized. The airflow tends to scrub the dirt from the filter 180 during use. The dirt cup may be emptied by releasing the latch 174 and removing the filter assembly 114. Dirt is retained in the dirt chamber 200 during this operation but is easily emptied therefrom over a dirt receptacle. From time to time the filter 180 may be removed for thorough cleaning or replacement if necessary.

What is claimed is:

1. A vacuum cleaner assembly comprising a motor housing having an end wall;

a motor and fan assembly mounted in said motor housing so that said fan is closely adjacent said end wall; an aperture defined by said end wall;

a ring fitting surrounding said aperture and defining an opening for air flow to said fan;

a dirt cup removably attached to said end wall and defining a hollow containment chamber with a suction inlet opening at its distal end;

said ring fitting having a hood portion extending across said aperture and having a rim portion extending around a periphery of said aperture with said hood portion being integrally associated with a portion of said rim portion;

a filter mounted within said containment chamber and separating said containment chamber into an air flow chamber and a dirt chamber with said suction inlet opening in communication with said dirt chamber;

said filter having a proximal edge in sealing communication with said end wall and hood portion, whereby dirt laden air will be drawn through said suction inlet opening into said dirt chamber and clean air will pass through said filter to said airflow chamber, through said aperture and said fan.

2. A vacuum cleaner assembly according to claim 1 wherein said hood is shaped as a spheroidal segment with a semi-circular portion being integrally associated with said rim portion of said ring fitting and another semi-circular portion sealingly engaging a complimentary portion of said proximal edge of said filter.

3. A vacuum cleaner according to claim 1 wherein said filter is substantially planar and is positioned in said containment chamber in substantial alignment with the direction of air flow from said inlet opening to said fan.

4. A vacuum cleaner according to claim 1 including a nozzle assembly pivotally attached to said suction inlet opening.

5. A vacuum cleaner according to claim 4 including a stick handle removably attached to said motor housing.

6. A vacuum cleaner assembly comprising, a motor housing having an end wall;

a motor and fan assembly mounted in said motor housing so that said fan is closely adjacent said end wall;

an aperture defined by said end wall;

means defining a containment chamber having a proximal end removably attached to said end wall and a distal end defining an intake opening;

a planar filter within said containment chamber and extending from said distal end to said proximal end of said containment chamber to separate said containment chamber into an air flow chamber and a dirt chamber;

said aperture being separated from air flow communication with said intake opening by said filter.

* * * * *